US006945396B2

(12) United States Patent
Dimbath

(10) Patent No.: US 6,945,396 B2
(45) Date of Patent: Sep. 20, 2005

(54) CARRYING BAG FOR A BRASS INSTRUMENT

(76) Inventor: Wolfgang Dimbath, Schaliershofer Strasse 110, 91056 Erlangen (DE)

( * ) Notice: Subject to any disclaimer, the term of this patent is extended or adjusted under 35 U.S.C. 154(b) by 7 days.

(21) Appl. No.: 10/697,759

(22) Filed: Oct. 30, 2003

(65) Prior Publication Data

US 2004/0118717 A1 Jun. 24, 2004

(30) Foreign Application Priority Data

Dec. 10, 2002 (DE) ..... 102 57 516

(51) Int. Cl.[7] ..... A45C 11/00
(52) U.S. Cl. ..... 206/314; 150/162
(58) Field of Search ..... 206/314; D3/204; 84/453; 150/162

(56) References Cited

U.S. PATENT DOCUMENTS

| | | | | | |
|---|---|---|---|---|---|
| 270,640 | A | * | 1/1883 | Oundy | 206/314 |
| 1,888,927 | A | * | 11/1932 | Lang | 206/314 |
| 1,900,718 | A | * | 3/1933 | Lang | 206/314 |
| 4,427,113 | A | | 1/1984 | Wanner | |
| 4,738,180 | A | | 4/1988 | McKnight | |
| 5,219,075 | A | * | 6/1993 | White | 206/314 |
| 6,464,074 | B1 | * | 10/2002 | Dimbath | 206/314 |
| 2002/0092783 | A1 | * | 7/2002 | Banner | 206/314 |

FOREIGN PATENT DOCUMENTS

| | | |
|---|---|---|
| DE | 94 03 042.1 | 6/1994 |
| DE | 298 15 101 | 7/2000 |
| DE | 200 21 141 | 4/2001 |

* cited by examiner

*Primary Examiner*—Bryon P. Gehman
(74) *Attorney, Agent, or Firm*—Ursula B. Day

(57) ABSTRACT

A carrying bag for a brass instrument includes a shell made of flexible material and having opposite end portions. A transport member, e.g. a handle, is secured to the shell. Arranged in the interior of the shell at one of the end portions adjacent to a bell of a brass instrument is a closed stiffening frame which is made of a firm material. The stiffening frame includes a ring-shaped closed end piece and a rim portion attached all-round about the end piece and pointing toward the interior of the shell.

25 Claims, 3 Drawing Sheets

CARRYING BAG FOR A BRASS INSTRUMENT

CROSS-REFERENCES TO RELATED APPLICATIONS

This application claims the priority of German Patent Application, Serial No. 102 57 516.9, filed Dec. 10, 2002, pursuant to 35 U.S.C. 119(a)–(d), the disclosure of which is incorporated herein by reference.

BACKGROUND OF THE INVENTION

The present invention relates, in general, to a carrying bag for a brass instrument.

A brass instrument, such as a trumpet, tuba, bugle, trombone or euphonium, is a very sensitive and generally precious musical instrument. Therefore, when not in use, the brass instrument must be protected in a case. During transport, brass instruments are placed in a padded carrying bag having a transport member, such as carrying straps and/or handles. While carrying bags for brass instruments should provide adequate protection, there should also be of light-weight construction so that the user is not unduly inconvenienced, when carrying the bag with the instrument. The need to reconcile a sufficient protection with a desire for a lightest possible construction of the carrying bag poses a problem heretofore.

Carrying bags for brass instruments are known having a shell in which a rigid wire is incorporated in an area that is at risk, e.g., the rim of the bell of the brass instrument. Compared to the shell and the instrument, the wire is fairly light. While suitable for stabilizing the contour of the shell, the wire is insufficient to protect against physical impact.

Another construction of a carrying bag for brass instruments involves the use of a plate which can be made of hard fibers, wood, plastic or metal and is placed or incorporated in the area of a front or end surface to extend continuously from top to bottom. A carrying bag of this type is relatively heavy. Moreover, while the incorporated plates may provide protection against impacts that strike the respective end surface in a direction perpendicular to the plate, they afford no protection against blows from the side. Thus, the rim of the bell of, e.g., a trumpet placed into the carrying bag, is still exposed to a risk of damage by blows.

The various proposals are thus endowed with drawbacks and shortcomings relating to the effect that is hoped to be obtained but could not be realized.

It would therefore be desirable and advantageous to provide an improved carrying bag to obviate prior art shortcomings and to protect the accommodated brass instrument while yet being of light-weight construction.

SUMMARY OF THE INVENTION

According to one aspect of the present invention, a carrying bag for a brass instrument includes a shell having opposite end portions and made of flexible material, a transport member secured to the shell, and a closed stiffening frame made of a firm material and arranged in the interior of the shell at one of the end portions adjacent to a bell of a brass instrument.

The present invention resolves prior art problems by providing a frame on the inside of the shell at the front or end portion in the area of the bag edge for reinforcement of the flexible shell. While an effective protection of the brass instrument is realized from impacts, blows, also from the side or even from the rear, or when the carrying bag is put down hard on a surface, the overall weight of the carrying bag is barely increased. The carrying bag according to the present invention exhibits an increased strength of the shell through incorporation of the frame. Such a frame can be produced very cost-efficiently, and inserted even at a later time, and does not significantly increase the weight of the carrying bag.

Suitably, the frame may be made of plastic, e.g. acrylonitrile-butadiene-styrene copolymer (ABS), or of light metal, such as aluminum, or of wood.

According to another feature of the present invention, the frame may be attached interiorly to the shell by gluing, riveting, or screwing, or by means of a Velcro-fastener. Also conceivable is a clamping of the frame interiorly to the one end portion.

According to another feature of the present invention, the stiffening frame may include a ring-shaped closed end piece and a rim portion attached all-round about the end piece and pointing toward the interior of the shell. In this way, the carrying bag is especially well-protected against blows and provides a protection of the bell rim against blows and impacts from the side or even from the rear.

The width of the ring-shaped end piece and the width of the attached rim portion are dependent on the size of the bell of the brass instrument that is to be carried for transport, and dependent on the material being used. Practice has shown that it is sufficient to provide the end piece with a width of about 2 cm to 6 cm and the rim portion also with a width of about 2 cm to 6 cm.

The contour of the end piece can be made dependent on the shape of the end portion of the shell. Thus, the end piece may be circular, or according to another feature of the present invention, the end piece may include a straight bottom strip and a U-shaped arcuate strip which is arranged onto the bottom strip. Such configuration results in a high stability when the carrying bag is placed on a ground.

According to another feature of the present invention, the shell may be comprised of three layers. Suitably, the shell includes an outer layer of textile material, a middle layer made of upholstery material, e.g. foam, and an inner layer made of a lining, whereby the frame is constructed to rest against an inner one of the three layers.

According to another feature of the present invention, the one end portion may extend in a vertical direction or at an inclination with respect to the vertical, when the brass instrument is received in the interior of the shell and carried. Suitably, the one end portion is substantially planar.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
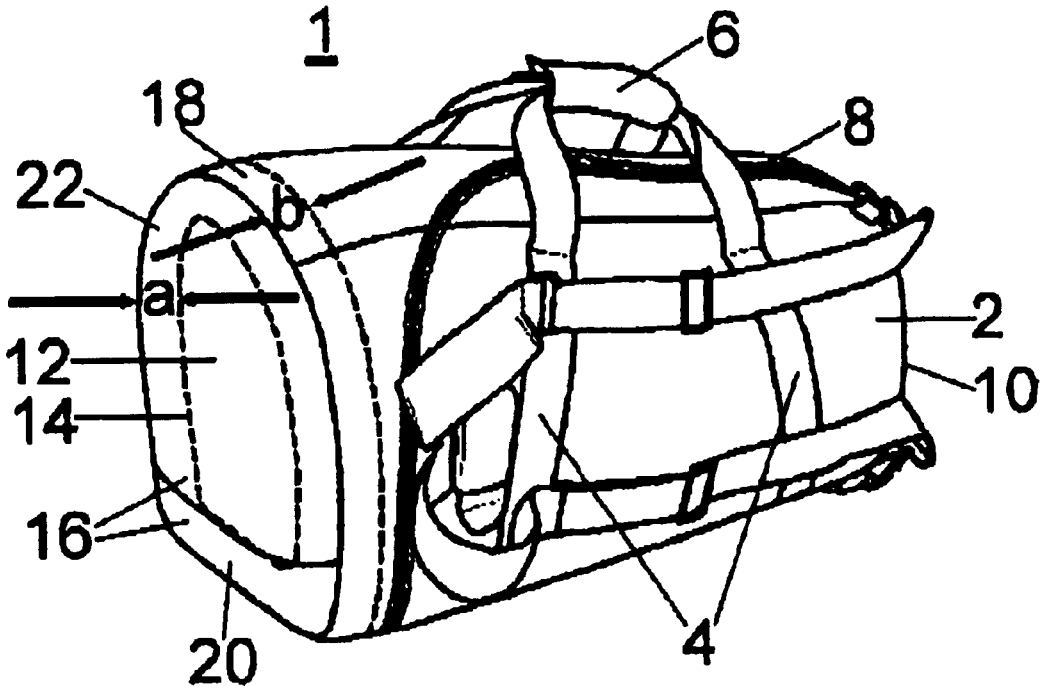
FIG. 1 is a schematic perspective illustration of one embodiment of a carrying bag according to the present invention for transport of a brass instrument such as an euphonium or trumpet.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic perspective illustration of one embodiment of a carrying bag according to the present invention, generally designated by reference numeral 1, for transport of a brass instrument such as an euphonium or trumpet. The carrying bag has a shell 2 which is provided on both longitudinal sides with a trimming 4 for providing a transport member. The trimming 4 includes two straps which are united by means of a wrapper to form a handle 6. Of course, it is also possible to provide the carrying bag 1 with a single handle that is disposed at the balanced center of gravity of the loaded carrying bag 1. A zipper 8 is provided in the shell 1 to allow opening of the carrying bag 1 for placement of the brass instrument.

The shell 2 of the carrying bag 1 has opposite, essentially planar and vertical end surfaces 10, 12 in parallel relationship. The end surface 10 of the shell 2 is hereby smaller than the opposite end surface 12. When placing a brass instrument in the carrying bag 1, the bell of the brass instrument is received in the area of the greater end surface 12.

Arranged in the area of the edge of the greater end surface 12 inside the shell 2, the carrying bag 1 is provided with a stiffening frame 14 which is shown by way of broken line and made of a firm material for protecting the rim of the accommodated bell against blows, impacts, or when the carrying bag is put down hard on a surface. Although conceivable, the smaller end surface 10 is not provided with such a stiffening frame.

The stiffening frame 14 is comprised of end piece 16, which is constructed in the form of a closed ring with an opening 13, and a rim portion 18 which is arranged all-round about the end piece 16 and extends inwards. Practice has shown that it is sufficient to provide the end piece 16 with a width "a" of about 2 cm to 6 cm and the rim portion 18 with a width "b" of about 2 cm to 6 cm, to thereby achieve the desired protection against blows from the side and even from the back. Hereby, the provision of the rim portion 18 is especially effective. In the non-limiting example of FIG. 1, the width "a" is 3 cm and the width "b" is 3 cm. Dimensioning of the widths "a" and "b" is dependent on the size of the bell of the brass instrument that is intended for transport.

Examples of a suitable material for the stiffening frame 14 include plastic such as e.g. acrylonitrile-butadiene-styrene copolymer (ABS), which is relatively inexpensive and lightweight, or polypropylene or nylon. Plastics involved here should be easy to make or to process, e.g. through deep-drawing in the case of ABS. Other production methods that are conceivable include spraying. In general, the stiffening frame 14 has substantial strength but yet is elastic enough to satisfy the demanded protective function. Other material examples include light metal, such as aluminum, or wood. A metal frame may be made through casting. A wooden frame may be of single-piece configuration or may be of multi-part configuration.

In some applications, it may be sufficient to incorporate the stiffening frame 14 inside the shell 2 in the area of the inner side of the end surface 12 and to clamp it there. Of course, a permanent and tight securement of the stiffening frame 4 upon the inner wall surface or in the area of the corners of the carrying bag 1 may be realized as well. The stiffening frame 14 may be secured by gluing, riveting, or threaded engagement. If replacement or exchange is intended, the provision of a Velcro fastener is conceivable as well.

Figure 4:
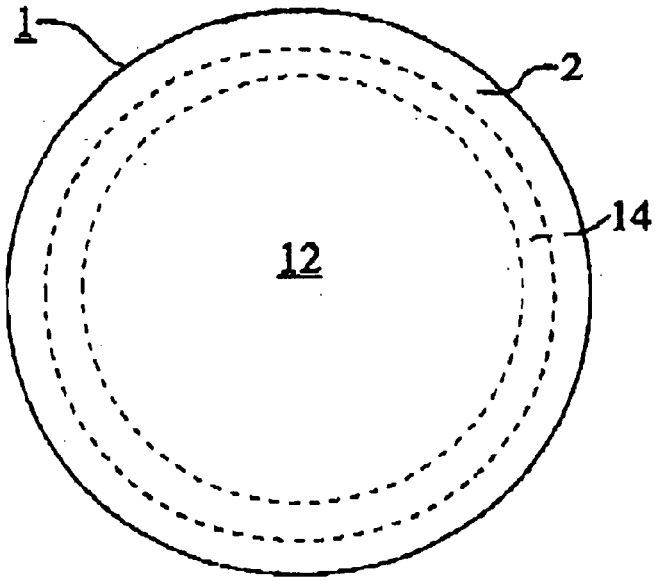
FIG. 4 is a plan view of an end surface of still another embodiment of a carrying bag according to the present invention.

As shown in FIG. 1, the single-piece and ring-shaped closed end piece 16 of the stiffening frame 14 includes a straight bottom strip 20 and a U-shaped arcuate strip 22 which is arranged onto the bottom strip 20. Although this configuration is a currently preferred embodiment, other configurations that generally follow the concepts outlined here are, of course, conceivable as well. An example is shown in FIG. 4 which depicts a plan view onto the end surface 12 of a carrying bag 1*a*, with the end surface 12 having a circular configuration. The thickness of the shell 2 is indicated by broken line. The stiffening frame 14, shown here also by broken line, is circular as well and bears closely against the inner side of the shell 2.

Figure 2:
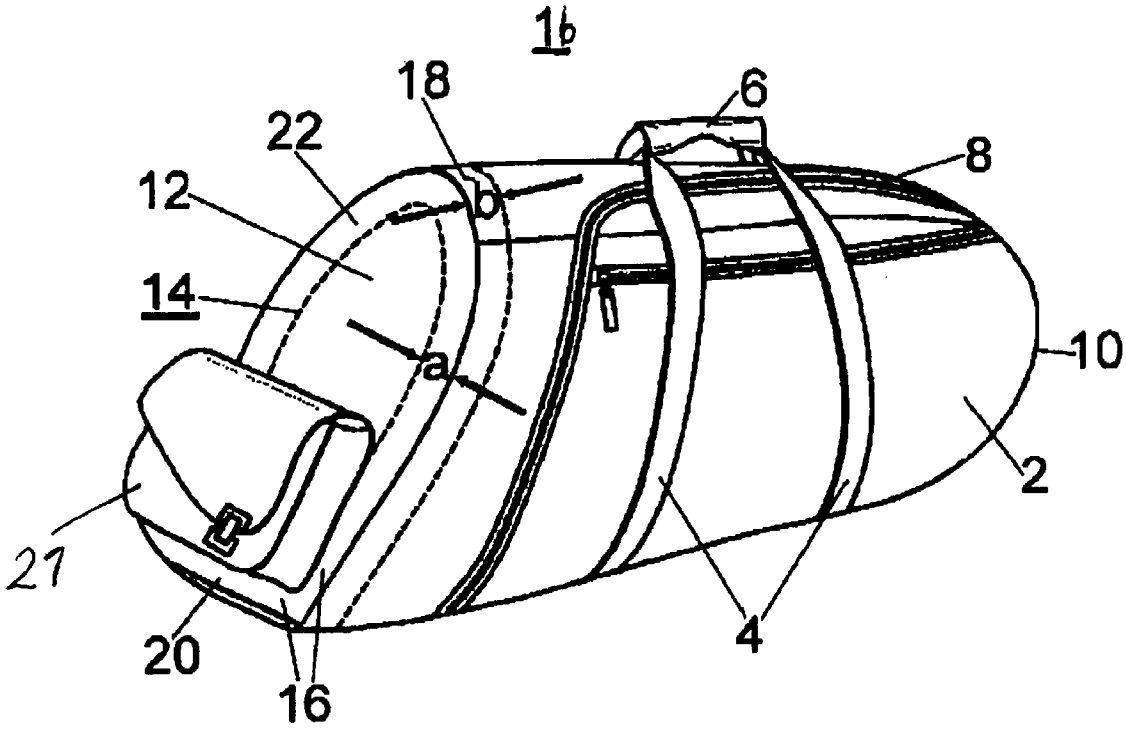
FIG. 2 is a schematic perspective illustration of another embodiment of a carrying bag according to the present invention for transport of a brass instrument such as a tenor horn or bugle.

Turning now to FIG. 2, there is shown a schematic perspective illustration of another embodiment of a carrying bag 1*b* according to the present invention for transport of a brass instrument such as a tenor horn or bugle. Parts corresponding with those in FIG. 1 are denoted by identical reference numerals and not explained again. The description below will center on the differences between the embodiments. In the embodiment of FIG. 2, the end surface 10 of smaller dimension has an outwardly arched configuration while the relatively greater end surface 12 is planar and extending at an inclination to the longitudinal axis of the carrying bag 1*b*. In addition, a pocket 21 is attached to the end surface 12 for storing other items. Of course, the carrying bag 1 of FIG. 1 may also be provided with such a pocket 21.

Figure 3:
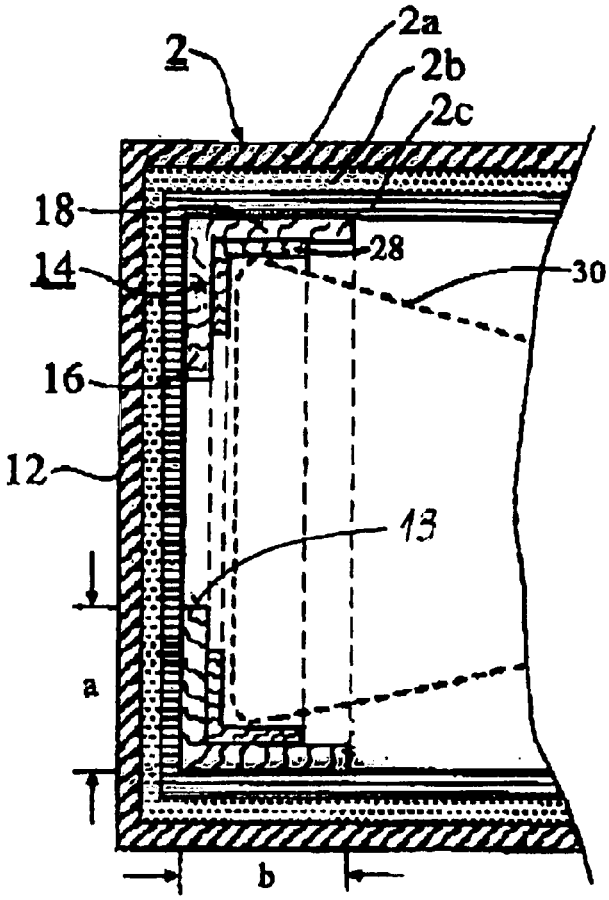
FIG. 3 is a horizontal section of a carrying bag according to the present invention.

The shell 2 may be made of a single layer of flexible material, or of several layers. Currently preferred is a configuration of the shell 2 of three layers in order to realize a carrying bag of high quality. A shell 2 of this type is shown, by way of example, in FIG. 3 and includes an outer layer 2*a* made of textile material, a middle layer 2*b* made of upholstery material, such as foam, and an inner layer 2*c* made of lining, e.g. cotton cloth. In general, the stiffening frame 14 may be incorporated into the shell material, i.e. between two neighboring layers. Currently preferred is however a disposition of the stiffening frame 14 against the inner layer 2*c*, whereby a padding 28 is incorporated between the stiffening frame 14 and the bell 30, shown in broken line, of the brass instrument to prevent a contact of the bell 30 with the relatively hard stiffening frame 14. The padding 28 is suitably of circular configuration.

During transport of the brass instrument in the carrying bag 1 of FIG. 1, the end surface 12, upon which the bell 30 of the brass instrument bears against, extends vertically, whereas the end surface 12 of the shell 2 of the carrying bag 1*b* of FIG. 2 extends at an inclination in relation to the vertical. Still, in all embodiments of the carrying bag 1, 1*a*, 1*b*, the configuration of the incorporated stiffening frame 14 rests against the contour in the area of the edges or corners of the shell 2.

In the embodiments of the carrying bag 1, 1*a*, 1*b*, the U-shaped bottom strip 22 of the incorporated stiffening frame 14 affords the carrying bag according to the present invention a high stability when placed on a surface. Practice has shown no tendency of the carrying bag to topple over, thereby further enhancing the protection of the accommodated valuable brass instrument.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A carrying bag for a brass instrument, comprising:

a shell having an interior and made of flexible material, said shell having opposite end portions;

a transport member secured to the shell; and a stiffening frame made of a firm material and arranged in the interior of the shell at one of the end portions adjacent to a bell of a brass instrument and sized to extend around the outer surface of the bell.

2. The carrying bag of claim 1, wherein the transport member comprises a handle.

3. The carrying bag of claim 1, wherein the frame is made of plastic.

4. The carrying bag of claim 1, wherein the frame is made of acrylonitrile-butadiene-styrene copolymer (ABS).

5. The carrying bag of claim 1, wherein the frame is made of propylene.

6. The carrying bag of claim 1, wherein the frame is made of nylon.

7. The carrying bag of claim 1, wherein the frame is made of light metal.

8. The carrying bag of claim 1, wherein the frame is made of aluminum.

9. The carrying bag of claim 1, wherein the frame is made of wood.

10. The carrying bag of claim 1, wherein the frame is attached interiorly to the shell by a connecting process selected from the group consisting of gluing, riveting, screwing, and a loop-and-hook fastener.

11. The carrying bag of claim 1, wherein the frame is clamped interiorly to the one end portion.

12. The carrying bag of claim 1, wherein the stiffening frame is a separate component of closed configuration.

13. The carrying bag of claim 1, wherein the stiffening frame includes an end piece constructed in the form of a ring with an opening, and a rim portion attached about the end piece and pointing toward the interior of the shell for externally encircling at least a front portion of the bell.

14. The carrying bag of claim 13, wherein the end piece has a width of about 2 cm to 6 cm, and the rim portion has a width of about 2 cm to 6 cm.

15. The carrying bag of claim 13, wherein the end piece includes a straight bottom strip and a U-shaped arcuate strip placed onto the bottom strip.

16. The carrying bag of claim 13, wherein the end piece has a circular configuration.

17. The carrying bag of claim 1, wherein the shell is comprised of three layers.

18. The carrying bag of claim 17, wherein the frame rests against an inner one of the three layers.

19. The carrying bag of claim 17, wherein the shell includes an outer layer of textile material, a middle layer made of upholstery material, and an inner layer made of a lining or cotton cloth.

20. The carrying bag of claim 19, wherein the upholstery material is foam.

21. The carrying bag of claim 1, and further comprising a padding between the frame and the bell of the brass instrument.

22. The carrying bag of claim 1, wherein the one end portion extends in a vertical direction, when the brass instrument is received in the interior of the shell and carried.

23. The carrying bag of claim 1, wherein the one end portion extends at an inclination with respect to a vertical, when the brass instrument is received in the interior of the shell and carried.

24. The carrying bag of claim 1, wherein the one end portion is substantially planar.

25. In combination:

a carrying bag including a shell having an interior and made of flexible material, said shell having opposite end portions, a transport member secured to the shell, and a stiffening frame made of a firm material and arranged in the interior of the shell at one of the end portions; and a brass instrument having a bell, said brass instrument being placed in the carrying bag with the bell positioned adjacent to the stiffening frame, the stiffening frame sized to extend around the outer surface of the bell.

* * * * *